US010189286B2

(12) United States Patent
Aoki

(10) Patent No.: US 10,189,286 B2
(45) Date of Patent: Jan. 29, 2019

(54) CONVEYANCE APPARATUS OF WEB PRINT MEDIUM

(71) Applicant: RISO KAGAKU CORPORATION, Tokyo (JP)

(72) Inventor: Kazuyuki Aoki, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 12 days.

(21) Appl. No.: 15/443,022

(22) Filed: Feb. 27, 2017

(65) Prior Publication Data

US 2017/0282602 A1 Oct. 5, 2017

(30) Foreign Application Priority Data

Mar. 30, 2016 (JP) ..... 2016-067650

(51) Int. Cl.

| | |
|---|---|
| ***B41J 15/00*** | (2006.01) |
| ***B41J 13/00*** | (2006.01) |
| ***B65H 23/18*** | (2006.01) |
| ***B41J 15/16*** | (2006.01) |

(52) U.S. Cl.

CPC ..... *B41J 13/0009* (2013.01); *B41J 15/16* (2013.01); *B65H 23/1806* (2013.01)

(58) Field of Classification Search

CPC ... B41J 13/0009; B41J 15/16; B65H 23/1806; B65H 23/1825; B65H 23/1888; B65H 23/1955; B65H 23/198; B65H 23/06; B65H 23/063; B65H 23/066; B65H 23/044; B65H 23/08; B65H 23/085; B65H 23/14;

(Continued)

(56) References Cited

U.S. PATENT DOCUMENTS 4,288,045 A * 9/1981 Romhild ..... B65H 23/1888 242/421.6
6,491,461 B1 * 12/2002 Nakajima ..... B26D 1/205 242/335

(Continued)

FOREIGN PATENT DOCUMENTS

| | | |
|---|---|---|
| JP | 2011-152670 A | 8/2011 |
| JP | 2013-71323 A | 4/2013 |
| JP | 2016-023007 A | 2/2016 |

OTHER PUBLICATIONS

Search Report issued in European Patent Office (EPO) Patent Application No. 17158329.7, dated Oct. 5, 2017.

*Primary Examiner* — Julian D Huffman
*Assistant Examiner* — Michael T Konczal
(74) *Attorney, Agent, or Firm* — Greenblum & Bernstein, P.L.C.

(57) ABSTRACT

A conveyance apparatus includes a conveyance roller, a conveyance motor, a back tension roller, a conveyance speed detector, a brake, and a controller. The controller is configured to: based on a conveyance speed of a web detected by the conveyance speed detector, control a value of a drive control parameter of the conveyance motor such that the conveyance speed of the web is equal to a target speed; and, based on an output torque of the conveyance motor corresponding to the value of the drive control parameter, adjust a braking force of the brake applied to the back tension roller which applies a tension to the web such that the tension of the web is equal to a target tension.

6 Claims, 4 Drawing Sheets

(58) Field of Classification Search
CPC .... B65H 23/105; B65H 23/18; B65H 23/188; B65H 23/192
See application file for complete search history.

(56) References Cited

U.S. PATENT DOCUMENTS

| | | | | |
|---|---|---|---|---|
| 8,033,624 | B2 * | 10/2011 | Silva et al. | B41J 3/00 347/4 |
| 9,550,641 | B2 | 1/2017 | Inoue | |
| 2004/0175213 | A1 | 9/2004 | Matsuzuki et al. | |
| 2006/0191437 | A1 * | 8/2006 | Mader | B41J 11/46 101/485 |
| 2015/0035921 | A1 | 2/2015 | Satake | |
| 2016/0288545 | A1 | 10/2016 | Shinohara et al. | |
| 2016/0373033 | A1 | 12/2016 | Suzuki | |

* cited by examiner

CONVEYANCE APPARATUS OF WEB PRINT MEDIUM

CROSS REFERENCE TO RELATED APPLICATION

This application is based upon and claims the benefit of priority from the prior Japanese Patent Application No. 2016-067650, filed on Mar. 30, 2016, the entire contents of which are incorporated herein by reference.

BACKGROUND

1. Technical Field

The disclosure relates to a conveyance apparatus which conveys a web.

2. Related Art

Japanese Unexamined Patent Application Publication No. 2013-71323 proposes a printing apparatus which continuously conveys a long web as a print medium and, at the same time, performs printing on the web by ejecting ink from an inkjet head.

Among printing apparatuses of the aforementioned type, there is one which includes a conveyance roller arranged downstream of the inkjet head and a back tension roller arranged upstream of the inkjet head. The conveyance roller is driven by a motor and conveys the web. A brake is connected to the back tension roller and the back tension roller applies tension to the web by receiving the braking force of this brake.

In such a printing apparatus, the conveyance speed of the web is detected by an encoder or the like provided in the motor and the motor is controlled based on the detected conveyance speed to maintain the conveyance speed of the web at fixed speed. The conveyance speed of the web is maintained at the fixed speed to prevent deviation of ink landing positions and obtain good print quality.

However, when the aforementioned motor control is performed to maintain the conveyance speed of the web at the fixed speed, the output torque of the motor changes and the tension of the web between the conveyance roller and the back tension roller changes. When the tension of the web changes, the web vibrates and the distance between the inkjet head and the web changes in some cases. When the distance between the inkjet head and the web changes, there is a risk that the ink landing positions deviate and the print quality decreases.

In view of this, in such a printing apparatus, a tension detector is installed between the conveyance roller and the back tension roller, and the brake is controlled such that the tension is constant, based on the tension of the web detected by the tension detector.

SUMMARY

Meanwhile, providing the tension detector leads to complicated apparatus configuration. Moreover, the tension detector sometimes causes conveyance failure such as meandering of the web. Accordingly, it is desirable to suppress the tension change of the web without the tension detector.

An object of the disclosure is to provide a conveyance apparatus which can suppress tension change of a web without a tension detector.

A conveyance apparatus in accordance with some embodiments includes: a conveyance roller configured to convey a web and arranged downstream of an inkjet head for ejecting ink to the web in a conveyance direction of the web; a conveyance motor configured to drive the conveyance roller; a back tension roller arranged upstream of the inkjet head in the conveyance direction and configured to apply a tension to the web; a conveyance speed detector configured to detect a conveyance speed of the web; a brake configured to apply a braking force to the back tension roller; and a controller configured to control the conveyance motor and the brake. The controller is configured to: based on the conveyance speed of the web detected by the conveyance speed detector, control a value of a drive control parameter of the conveyance motor such that the conveyance speed of the web is equal to a target speed; and, based on an output torque of the conveyance motor corresponding to the value of the drive control parameter, adjust the braking force of the brake such that the tension of the web is equal to a target tension.

In the aforementioned configuration, it is possible to control the conveyance motor such that conveyance speed of the web is maintained at fixed speed and, at the same time, control the braking force of the brake such that the tension of the web is fixed, without directly detecting the tension of the web. Accordingly, tension change of the web can be suppressed without a tension detector for detecting the tension of the web.

The brake may include: a base brake configured to generate a base braking force; and an adjustment brake with a maximum output smaller than a maximum output of the base brake and with a response speed higher than a response speed of the base brake. The controller may be configured to adjust the braking force of the brake by adjusting a braking force of the adjustment brake.

In the aforementioned configuration, it is possible to finely adjust the braking force of the brake while providing required braking force.

Depending on a type and a size of the web, instead of adjusting the braking force of the brake such that the tension of the web is equal to the target tension, the controller may be configured to control the braking force of the brake such that the braking force of the brake is maintained constant at a braking force predetermined depending on the type and the size of the web.

In the aforementioned configuration, it is possible to omit the adjustment of the braking force while providing braking force required to suppress the oscillation of the web. As a result, it is possible to simplify the brake control while suppressing the oscillation of the web W.

The base braking force may be a constant force predetermined depending on a type and a size of the web.

DETAILED DESCRIPTION

Figure 1:
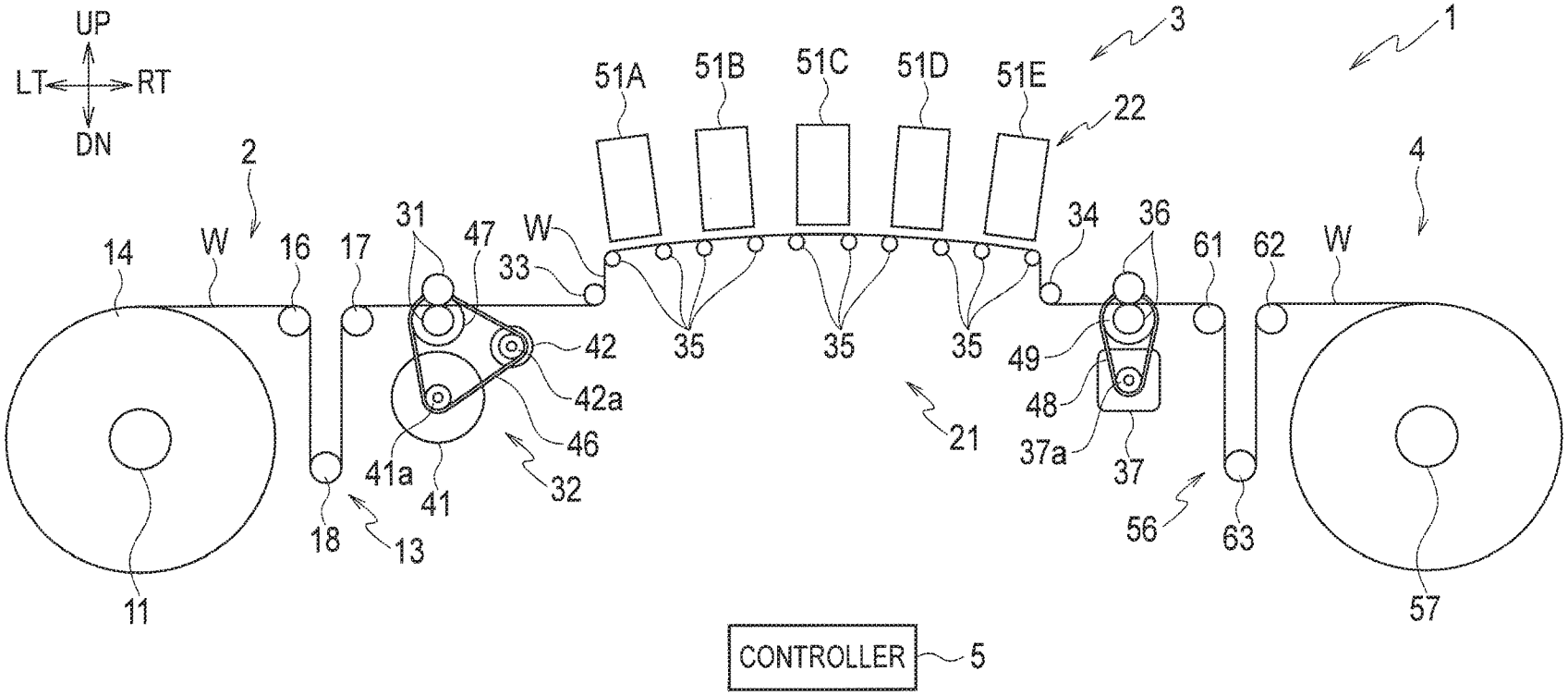
FIG. 1 is a schematic configuration diagram of a printing apparatus according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
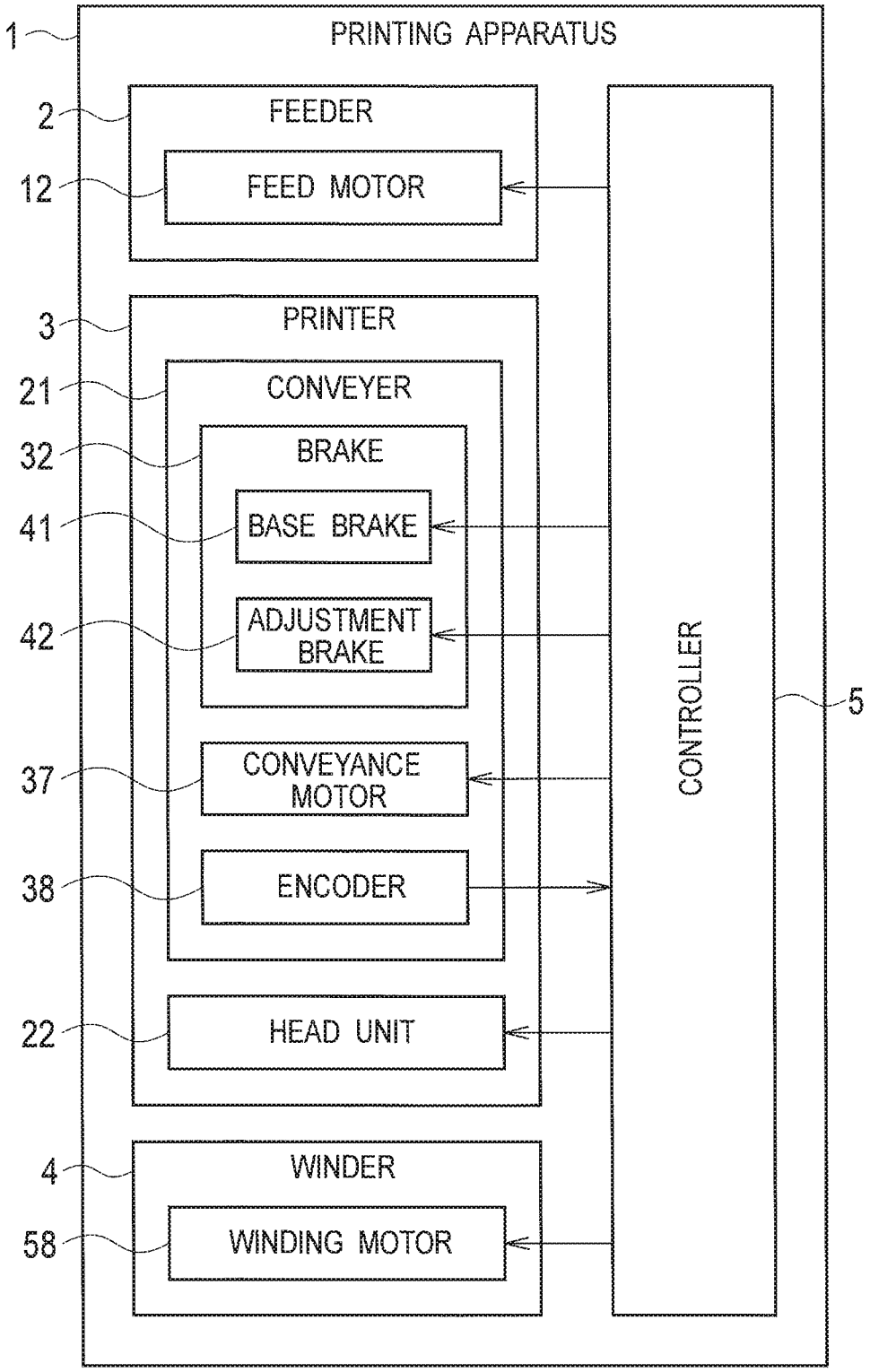
FIG. 2 is a control block diagram of a printing apparatus illustrated in FIG. 1.

FIG. 1 is a schematic configuration diagram of a printing apparatus 1 including a conveyance apparatus according to an embodiment of the present invention. FIG. 2 is a control block diagram of the printing apparatus 1 illustrated in FIG. 1. Note that, in FIG. 1, the rightward direction, the leftward direction, the upward direction, and the downward direction are denoted by RT, LT, UP, and DN, respectively. Moreover, the direction orthogonal to the sheet surface of FIG. 1 is referred to as a front-rear direction.

As illustrated in FIGS. 1 and 2, the printing apparatus 1 includes a feeder 2, a printer 3, a winder 4, and a controller 5. Note that the controller 5 and a conveyer 21 to be described later form the conveyance apparatus.

The feeder 2 feeds a web W which is a long print medium made of paper, film, or the like, to the printer 3. The feeder 2 includes a web roll support shaft 11, a feed motor 12, and an upstream buffer 13.

The web roll support shaft 11 supports a web roll 14 in a rotatable manner. The web roll support shaft 11 is formed in a long form extending in the front-rear direction. The web roll 14 is a roll of the web W.

The feed motor 12 rotates the web roll support shaft 11 clockwise in FIG. 1. The rotation of the web roll support shaft 11 causes the web roll 14 to rotate in the same direction and the web W is fed downstream (toward the right side).

The upstream buffer 13 absorbs a slack of the web W between the web roll 14 and the printer 3. The upstream buffer 13 includes support rollers 16, 17 and a dancer roller 18.

The support rollers 16, 17 support the web W between the web roll 14 and a pair of back tension rollers 31 of the printer 3 to be described later. The support rollers 16, 17 are arranged at the same height at an interval in a left-right direction.

The dancer roller 18 pushes down the web W with its own weight between the support rollers 16, 17. The dancer roller 18 thereby absorbs the slack of the web W. The dancer roller 18 moves up and down depending on the amount of slack in the web W.

The printer 3 prints an image on the web W while conveying the web W. The printer 3 includes the conveyer 21 and a head unit 22.

The conveyer 21 conveys the web W fed by the feeder 2. The conveyer 21 includes the pair of back tension rollers 31, a brake 32, guide rollers 33, 34, ten under-head support members 35, a pair of conveyance rollers 36, a conveyance motor 37, and an encoder 38.

The pair of back tension rollers 31 are rollers for applying tension to the web W. The pair of back tension rollers 31 are arranged upstream of the head unit 22 in a conveyance direction of the web W. The pair of back tension rollers 31 rotate by following the web W conveyed by the pair of conveyance rollers 36, while nipping the web W. The brake 32 applying brake to the back tension rollers 31 causes tension to be applied to the web W between the pair of the conveyance rollers 36 and the pair of back tension rollers 31.

The brake 32 applies braking force for applying tension to the web W, to the back tension rollers 31. The brake 32 includes a base brake 41 and an adjustment brake 42.

The base brake 41 generates base braking force to be applied to the back tension rollers 31. The base braking force is set (predetermined) depending on the type and size (width) of the web W. The base brake 41 is a brake with maximum output high enough to generate base braking force corresponding to various types of webs W used in the printing apparatus 1. The base brake 41 is, for example, a powder brake.

The base brake 41 includes an output shaft 41*a* configured to output braking force. The braking force of the base brake 41 is transmitted from the output shaft 41*a* to a pulley 47 via a brake belt 46, the pulley 47 coaxially connected to one of the back tension rollers 31. The braking force of the base brake 41 is thereby applied to the back tension rollers 31. The brake belt 46 is an annular belt wound around the pulley 47, the output shaft 41*a* of the base brake 41, and an output shaft 42*a* of the adjustment brake 42 to be described later.

The adjustment brake 42 is a brake for adjusting the braking force of the brake 32 which is to be applied to the back tension rollers 31. The adjustment brake 42 is a brake with maximum output smaller than the maximum output of the base brake 41 and with higher response speed to control than response speed of the base brake 41. The adjustment brake 42 is, for example, a powder brake.

The adjustment brake 42 includes the output shaft 42*a* configured to output braking force. The braking force of the adjustment brake 42 is transmitted from the output shaft 42*a* to the pulley 47 via the brake belt 46. The braking force of the adjustment brake 42 is thereby applied to the back tension rollers 31.

The guide roller 33 guides the web W between the pair of back tension rollers 31 and the most upstream under-head support member 35. The guide roller 34 guides the web W between the most downstream under-head support member 35 and the pair of conveyance rollers 36.

The under-head support members 35 support the web W under the head unit 22. The ten under-head support members 35 are arranged in an arch shape protruding upward. The web W is thereby set to a tensioned state between the adjacent under-head support members 35 and is maintained in a stable attitude.

The pair of conveyance rollers 36 convey the web W toward the winder 4 while nipping the web W. The pair of conveyance rollers 36 are arranged downstream of the head unit 22.

The conveyance motor 37 rotationally drives the conveyance rollers 36. The conveyance motor 37 includes a drive shaft 37*a* configured to output rotational drive force. The rotational drive force of the conveyance motor 37 is transmitted from the drive shaft 37*a* to a pulley 49 via a drive belt 48, the pulley 49 coaxially connected to one of the conveyance rollers 36. The conveyance rollers 36 are thereby rotationally driven.

The encoder 38 outputs a pulse signal every time the drive shaft 37*a* of the conveyance motor 37 rotates by a predetermined angle. The pulse signal outputted by the encoder 38 is used to detect the conveyance speed of the web W. The encoder 38 corresponds to a conveyance speed detector.

The head unit 22 prints an image on the web W conveyed by the conveyer 21. The head unit 22 includes inkjet heads 51A to 51E.

The inkjet heads 51A to 51E each have multiple nozzles (not illustrated) aligned in the front-rear direction (main scanning direction) and eject ink from the nozzles. The inkjet heads 51A to 51E are arranged above the web W conveyed by the conveyer 21.

The winder 4 winds the web W subjected to printing by the printer 3. The winder 4 includes a downstream buffer 56, a winding shaft 57, and a winding motor 58.

The downstream buffer 56 absorbs a slack of the web W between the printer 3 and the winding shaft 57. The downstream buffer 56 includes support rollers 61, 62 and a dancer roller 63.

The support rollers 61, 62 support the web W between the pair of conveyance rollers 36 and the winding shaft 57. The support rollers 61, 62 are arranged at the same height at an interval in the left-right direction.

The dancer roller 63 pushes down the web W with its own weight between the support rollers 61, 62. The dancer roller 63 thereby absorbs the slack of the web W. The dancer roller 63 moves up and down depending on the amount of slack in the web W.

The winding shaft 57 winds and holds the web W. The winding shaft 57 is formed in a long form extending in the front-rear direction.

The winding motor 58 rotates the winding shaft 57 clockwise in FIG. 1. The rotation of the winding shaft 57 causes the web W to be wound by the winding shaft 57.

The controller 5 controls operations of various units in the printing apparatus 1. The controller 5 includes a CPU, a RAM, a ROM, a hard disk, and the like.

In the printing, the controller 5 drives the inkjet heads 51A to 51E to eject the inks and perform printing on the web W, while driving the feeder 2, the conveyer 21, and the winder 4 to convey the web W.

While the web W is being conveyed, the controller 5 controls the conveyance speed of the web W. Specifically, the controller 5 controls a value of a drive control parameter of the conveyance motor 37 such that the conveyance speed of the web W is equal to print conveyance speed which is target speed, based on the conveyance speed of the web W detected by the encoder 38. In this case, the drive control parameter of the conveyance motor 37 is a parameter for controlling power supplied to the conveyance motor 37, and is specifically current, voltage, or the like. In the following description, the drive control parameter of the conveyance motor 37 in the embodiment is assumed to be the current.

Moreover, while the web W is being conveyed, the controller 5 performs brake control in a braking force variable mode or a braking force fixed mode, depending on the type and size of the web W.

The braking force variable mode is a mode in which the braking force of the brake 32 is changed such that the tension of the web W is maintained at target tension. In the braking force variable mode, the controller 5 adjusts the braking force of the brake 32 such that the tension of the web W is equal to the target tension, based on the output torque of the conveyance motor 37 corresponding to the current supplied to the conveyance motor 37.

The braking force fixed mode is a mode in which the braking force of the brake 32 is fixed. In the braking force fixed mode, the controller 5 performs control such that the braking force of the brake 32 is fixed (constant) at braking force set (predetermined) depending the type and size of the web W.

Next, operations of the printing apparatus 1 are described.

When a print job is inputted, the controller 5 first executes brake control mode selection processing. The brake control mode selection processing is processing in which the braking force variable mode or the braking force fixed mode is selected as the brake control mode in the conveyance of the web W. The brake control mode selection processing is described with reference to the flowchart of FIG. 3.

Figure 3:
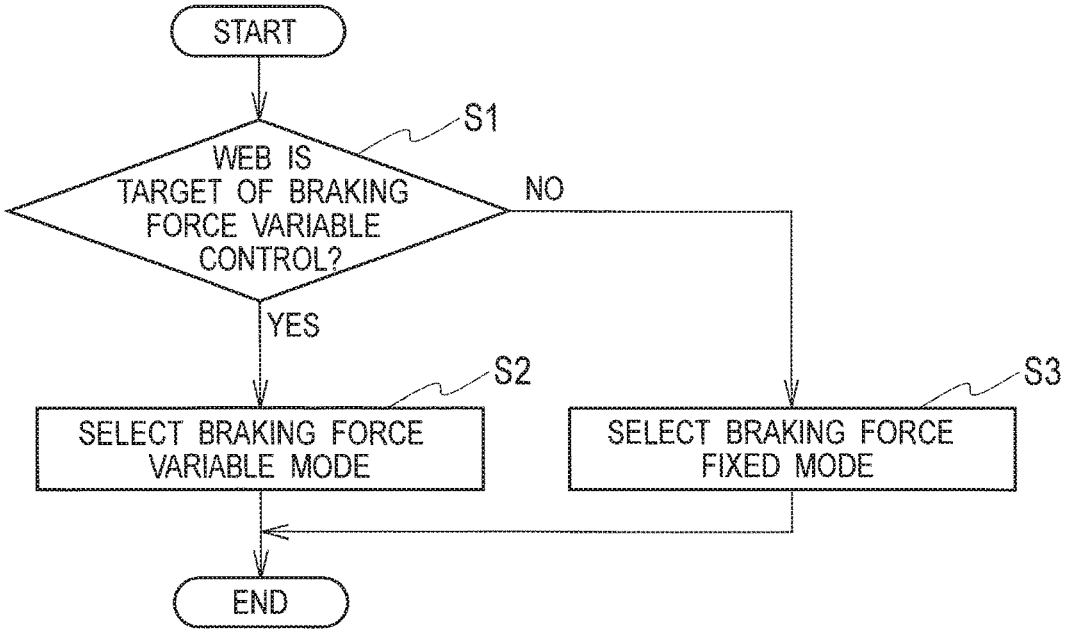
FIG. 3 is a flowchart of brake control mode selection processing.

When the print job is inputted, in step S1 of FIG. 3, the controller 5 determines whether the web W to be subjected to printing in this operation is a web being a target of the braking force variable control, based on setting information included in the print job.

In this case, the web being the target of the braking force variable control is a web other than a web being a target of the braking force fixed control. The web being the target of the braking force fixed control is a web of such type and size that a stretch amount between the inkjet head 51A and the inkjet head 51E is within an allowable range when tension high enough to suppress oscillation due to vibration within an allowable range is applied to the web. In other words, the web being the target of the braking force variable control is a web of such type and size that the stretch amount between the inkjet head 51A and the inkjet head 51E cannot be maintained within the allowable range when the tension high enough to suppress the oscillation due to vibration within the allowable range is applied to the web.

When the web W to be printed in this operation is determined to be the web being the target of the braking force variable control (step S1: YES), the controller 5 selects the braking force variable mode and terminates the brake control mode selection processing in step S2.

When the web W to be printed in this operation is determined not to be the target of the braking force variable control, that is, to be the web being the target of the braking force fixed control (step S1: NO), the controller 5 selects the braking force fixed mode and terminates the brake control mode selection processing in step S3.

After the brake control mode selection processing, the controller 5 starts the conveyance of the web W. Specifically, the controller 5 starts the drive of the feed motor 12, the brake 32, the conveyance motor 37, and the winding motor 58. The web W is thereby conveyed from the feeder 2 to the winder 4. In the printer 3, the brake 32 applies brake to the back tension rollers 31 and this causes the web W to be conveyed with the tension applied to the web W.

After the conveyance of the web W is started, the controller 5 controls the inkjet heads 51A to 51E based on the print job and causes the inkjet heads 51A to 51E to print an image on the web W.

Here, the conveyance speed of the web W changes in the conveyance of the web W due to unevenness in the thickness of the web W and the like. To counter this, the controller 5 performs the conveyance speed control to suppress the speed change of the web W in the printer 3 and maintain the print conveyance speed. The conveyance speed control of the web W is performed as follows.

Figure 4:
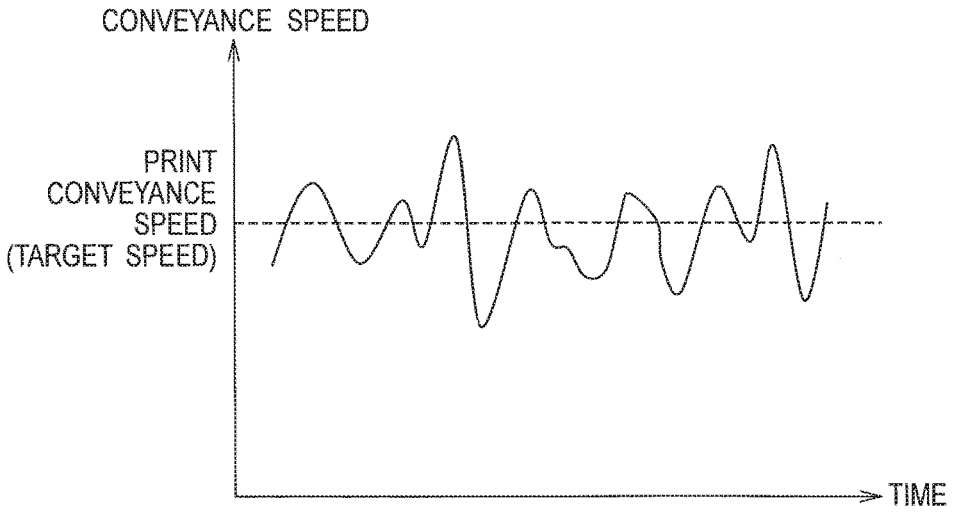
FIG. 4 is an explanatory diagram of conveyance speed control of a web.

While the web W is being conveyed, the controller 5 obtains the conveyance speed of the web W detected by the encoder 38. Specifically, the controller 5 calculates the number of revolutions of the conveyance motor 37 based on the pulse signal outputted by the encoder 38 and calculates the conveyance speed of the web W corresponding to the calculated number of revolutions. Then, the controller 5 controls the current supplied to the conveyance motor 37 such that there is no difference between the calculated conveyance speed and the print conveyance speed (target speed). The conveyance speed detected as illustrated in, for example, FIG. 4 is thereby controlled to match the print conveyance speed.

Figure 5:
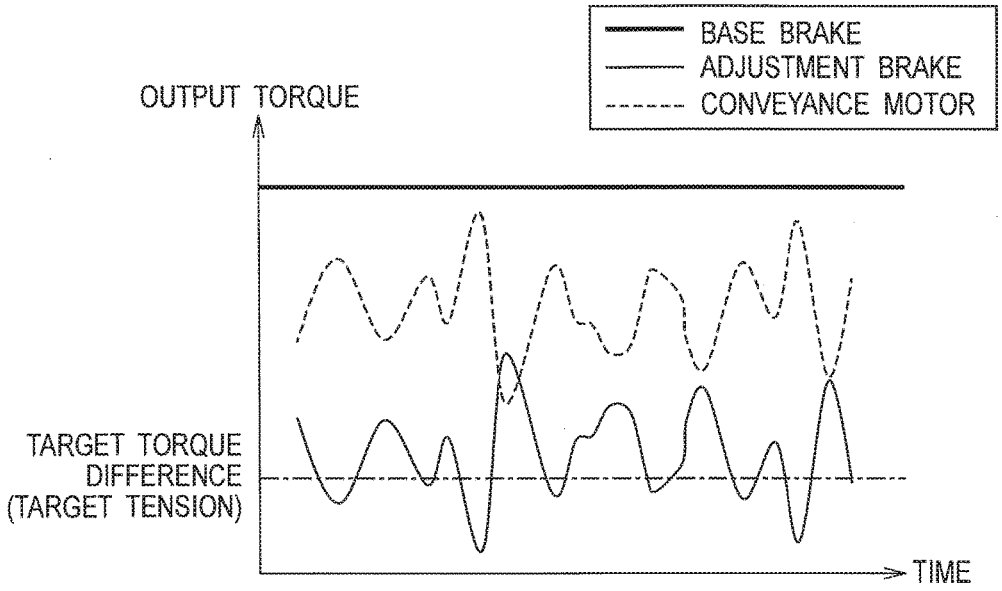
FIG. 5 is an explanatory diagram of brake control in a braking force variable mode.

Moreover, while the web W is being conveyed, the controller 5 performs the brake control in the braking force variable mode or the braking force fixed mode selected in the brake control mode selection processing. In FIG. 5, the bold solid line depicts the output torque of the base brake 41, the thin solid line depicts the output torque of the adjustment brake 42, the broken line depicts the output torque of the conveyance motor 37, and the alternate long and short dash line depicts a target torque difference described below.

First, the brake control in the braking force variable mode is described.

In the braking force variable mode, the controller 5 controls the base brake 41 such that the base brake 41 generates and maintains the base braking force depending on the type and size of the web W. As illustrated in FIG. 5, the output torque (braking force) of the base brake 41 is thus constant.

Moreover, the controller 5 calculates the output torque of the conveyance motor 37 corresponding to the current supplied to the conveyance motor 37. The value of the output torque of the conveyance motor 37 corresponding to the supplied current can be calculated from the motor characteristics of the conveyance motor 37. Then, the controller 5 adjusts the braking force (output torque) of the adjustment brake 42 such that the difference between the output torque of the conveyance motor 37 and the output torque of the brake 32 is equal to the target torque difference corresponding to the target tensile of the web W.

As illustrated in FIG. 5, the braking force (output torque) of the adjustment brake 42 is thus adjusted to cancel out the change in the output torque of the conveyance motor 37 which is caused by the conveyance speed control of the web W. As a result, the tension of the web W is maintained at the target tension. This suppresses vibration due to the change in the tension of the web W, and decrease in print quality is thereby suppressed.

Next, the brake control in the braking force fixed mode is described.

In the braking force fixed mode, the controller 5 controls the base brake 41 and the adjustment brake 42 such that, during the conveyance of the web W, the braking force of the brake 32 is fixed at the braking force preset depending on the type and size of the web W.

The braking force in the braking force fixed mode is set (predetermined) such that the tension high enough to suppress the oscillation due to vibration within the allowable range can be applied to the web W and the stretch amount of the web W between the inkjet head 51A and the inkjet head 51E is maintained within the allowable range when such tension is applied. In this case, the allowable ranges of the oscillation and stretch amount of the web W are set depending on an allowable range of a deviation amount of an ink landing position which is used to maintain good print quality.

Fixing the braking force of the brake 32 to the braking force described above can suppress the oscillation of the web W within the allowable range even when the output torque of the conveyance motor 37 changes due to the conveyance speed control of the web W. Accordingly, the decrease of print quality is suppressed.

When the printing based on the print job is completed, the controller 5 terminates the conveyance of the web W. Specifically, the controller 5 stops the feed motor 12, the brake 32, the conveyance motor 37, and the winding motor 58. The series of operations are thereby completed.

As described above, in the printing apparatus 1, the controller 5 controls the current supplied to the conveyance motor 37 such that the conveyance speed of the web W is equal to the print conveyance speed which is the target speed, based on the conveyance speed of the web W detected by the encoder 38. Moreover, in the braking force variable mode, the controller 5 adjusts the braking force of the brake 32 such that the tension of the web W is equal to the target tension, based on the output torque of the conveyance motor 37 corresponding to the current supplied to the conveyance motor 37. As a result, the printing apparatus 1 can control the conveyance motor 37 such that conveyance speed of the web W is maintained at the fixed speed and, at the same time, control the braking force of the brake 32 such that the tension of the web W is constant, without directly detecting the tension of the web W. Accordingly, the printing apparatus 1 can suppress tension change of the web W without being provided with a tension detector for detecting the tension of the web W.

Moreover, in the printing apparatus 1, the brake 32 includes the base brake 41 configured to generate the base braking force and the adjustment brake 42 with maximum output smaller than the maximum output of the base brake 41 and with higher response speed than response speed of the base brake 41. In addition, the controller 5 adjusts the braking force of the brake 32 by adjusting the braking force of the adjustment brake 42. Accordingly, it is possible to finely adjust the braking force of the brake 32 while providing required braking force.

Moreover, in the braking force fixed mode, the printing apparatus 1 controls the braking force of the brake 32 depending on the type and size of the web W, such that the braking force of the brake 32 is fixed at the braking force set depending on the type and size of the web W. It is thus possible to omit the adjustment of the braking force while providing braking force required to suppress the oscillation of the web W. As a result, it is possible to simplify the brake control while suppressing the oscillation of the web W.

Note that, although the configuration in which the brake 32 includes two brakes of the base brake 41 and the adjustment brake 42 is described in the aforementioned embodiment, the brake 32 may include one brake.

Although the configuration in which the braking force variable mode and the braking force fixed mode can be selectively used as the brake control mode is described in the aforementioned embodiment, the braking force fixed mode may be omitted. That is, only the braking force variable mode can be used for the web W of all types and sizes (i.e. both the web being the target of the braking force variable control and the web being the target of the braking force fixed control explained above).

Although the current is described as the drive control parameter of the conveyance motor 37 in the aforementioned embodiment, the drive control parameter is not limited to this and may be voltage or the like.

Although the encoder 38 is used to detect the conveyance speed of the web W in the aforementioned embodiment, the conveyance speed detector is not limited to this and a laser Doppler velocimeter or the like may be used.

Although the configuration in which the feeder 2 and the winder 4 are incorporated in the printing apparatus 1 is described in the aforementioned embodiment, a feeding apparatus and a winding apparatus which are separate apparatuses may be connected to the printing apparatus.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A conveyance apparatus comprising:

a conveyance roller configured to convey a web and arranged downstream of an inkjet head for ejecting ink to the web in a conveyance direction of the web;

a conveyance motor configured to drive the conveyance roller;

a back tension roller arranged upstream of the inkjet head in the conveyance direction and configured to apply a tension to a portion of the web located under the inkjet head in cooperation with the conveyance roller;

a conveyance speed detector configured to detect a conveyance speed of the web;

a brake configured to apply a braking force to the back tension roller; and a controller configured to control the conveyance motor and the brake, wherein the controller is configured to based on the conveyance speed of the web detected by the conveyance speed detector, control a value of a drive control parameter of the conveyance motor such that the conveyance speed of the web is equal to a target speed, the drive control parameter being a parameter for controlling power supplied to the conveyance motor, calculate an output torque of the conveyance motor corresponding to the value of the drive control parameter, and adjust the braking force of the brake such that a difference between the calculated output torque of the conveyance motor and an output torque of the brake is equal to a target torque difference corresponding to a target tension of the tension of the web.

2. The conveyance apparatus according to claim 1, wherein, depending on a type and a size of the web, instead of adjusting the braking force of the brake such that the tension of the web is equal to the target tension, the controller is configured to control the braking force of the brake such that the braking force of the brake is maintained constant at a braking force predetermined depending on the type and the size of the web.

3. The conveyance apparatus according to claim 1, wherein the brake comprises:

a base brake configured to generate a base braking force; and an adjustment brake with a maximum output smaller than a maximum output of the base brake and with a response speed higher than a response speed of the base brake, and the controller is configured to adjust the braking force of the brake by adjusting a braking force of the adjustment brake.

4. The conveyance apparatus according to claim 3, wherein, depending on a type and a size of the web, instead of adjusting the braking force of the brake such that the tension of the web is equal to the target tension, the controller is configured to control the braking force of the brake such that the braking force of the brake is maintained constant at a braking force predetermined depending on the type and the size of the web.

5. The conveyance apparatus according to claim 3, wherein the base braking force is a constant force predetermined depending on a type and a size of the web.

6. The conveyance apparatus according to claim 3, wherein the conveyance speed detector is configured to detect the conveyance speed of the web from a rotation of a drive shaft of the conveyance motor.

* * * * *